US006387216B1

(12) United States Patent
Koski

(10) Patent No.: US 6,387,216 B1
(45) Date of Patent: May 14, 2002

(54) LONG SHOELESS NIP PRESS

(75) Inventor: Ilpo Koski, Pori (FI)

(73) Assignee: Metso Chemical Pulping Oy, Pori (FI)

( * ) Notice: Subject to any disclaimer, the term of this patent is extended or adjusted under 35 U.S.C. 154(b) by 0 days.

(21) Appl. No.: 09/719,228

(22) PCT Filed: Apr. 26, 2000

(86) PCT No.: PCT/FI00/00356

§ 371 Date: Feb. 20, 2001

§ 102(e) Date: Feb. 20, 2001

(87) PCT Pub. No.: WO00/71811

PCT Pub. Date: Nov. 30, 2000

(30) Foreign Application Priority Data

May 21, 1999 (FI) ..... 991154

(51) Int. Cl.[7] ..... D21F 3/02

(52) U.S. Cl. ..... 162/205; 162/272; 162/358.3; 162/361; 100/153

(58) Field of Search ..... 162/205, 272, 162/358.3, 361; 100/153, 154

(56) References Cited

U.S. PATENT DOCUMENTS

| | | | | |
|---|---|---|---|---|
| 3,853,698 A | * | 12/1974 | Mohr | 162/358.3 |
| 4,287,021 A | * | 9/1981 | Justus et al. | 162/358.3 |
| 4,427,492 A | | 1/1984 | Cronin | 162/358.3 |
| 4,518,460 A | * | 5/1985 | Hauser et al. | 162/358.3 |
| 4,707,222 A | * | 11/1987 | Mullner | 162/358.3 |
| 4,919,761 A | * | 4/1990 | Schiel et al. | 162/358.3 |
| 5,071,513 A | | 12/1991 | Bluhm et al. | 162/206 |
| 5,084,137 A | * | 1/1992 | Ilmarinen et al. | 162/358.3 |
| 5,110,417 A | | 5/1992 | Lehtonen et al. | 162/358.3 |
| 5,262,011 A | | 11/1993 | Ilmarinen | 162/358.3 |
| 5,423,949 A | | 6/1995 | Ilmarinen | 162/358.3 |
| 5,643,416 A | * | 7/1997 | Lange et al. | 162/358.3 |
| 5,843,283 A | | 12/1998 | Henssler et al. | 162/358.3 |
| 6,017,422 A | | 1/2000 | Brox | 162/358.3 |
| 6,030,502 A | | 2/2000 | Meschenmoser | 162/358.3 |

FOREIGN PATENT DOCUMENTS

| | | |
|---|---|---|
| DE | 4311622 | 10/1994 |
| DE | 19544979 | 6/1997 |

* cited by examiner

*Primary Examiner*—Karen M. Hastings
(74) *Attorney, Agent, or Firm*—Burns, Doane, Swecker & Mathis L.L.P.

(57) ABSTRACT

A method of sealing the pressure chamber of a shoeless press comprising a roll and a concave counterpart provided with a nip pressure chamber and with a press belt by proportioning the edge radius of the pressure chamber and the radius of the path of the belt to the pressures acting under the belt. A pressure is generated under the press belt, outside the press chamber, with the aid of oil or gas, and a suitable lubrication leak is allowed from the pressure chamber by adjusting the pressure in the right proportion to the chamber pressure. The invention also includes an apparatus for carrying out the method.

17 Claims, 2 Drawing Sheets

LONG SHOELESS NIP PRESS

Figure 1:
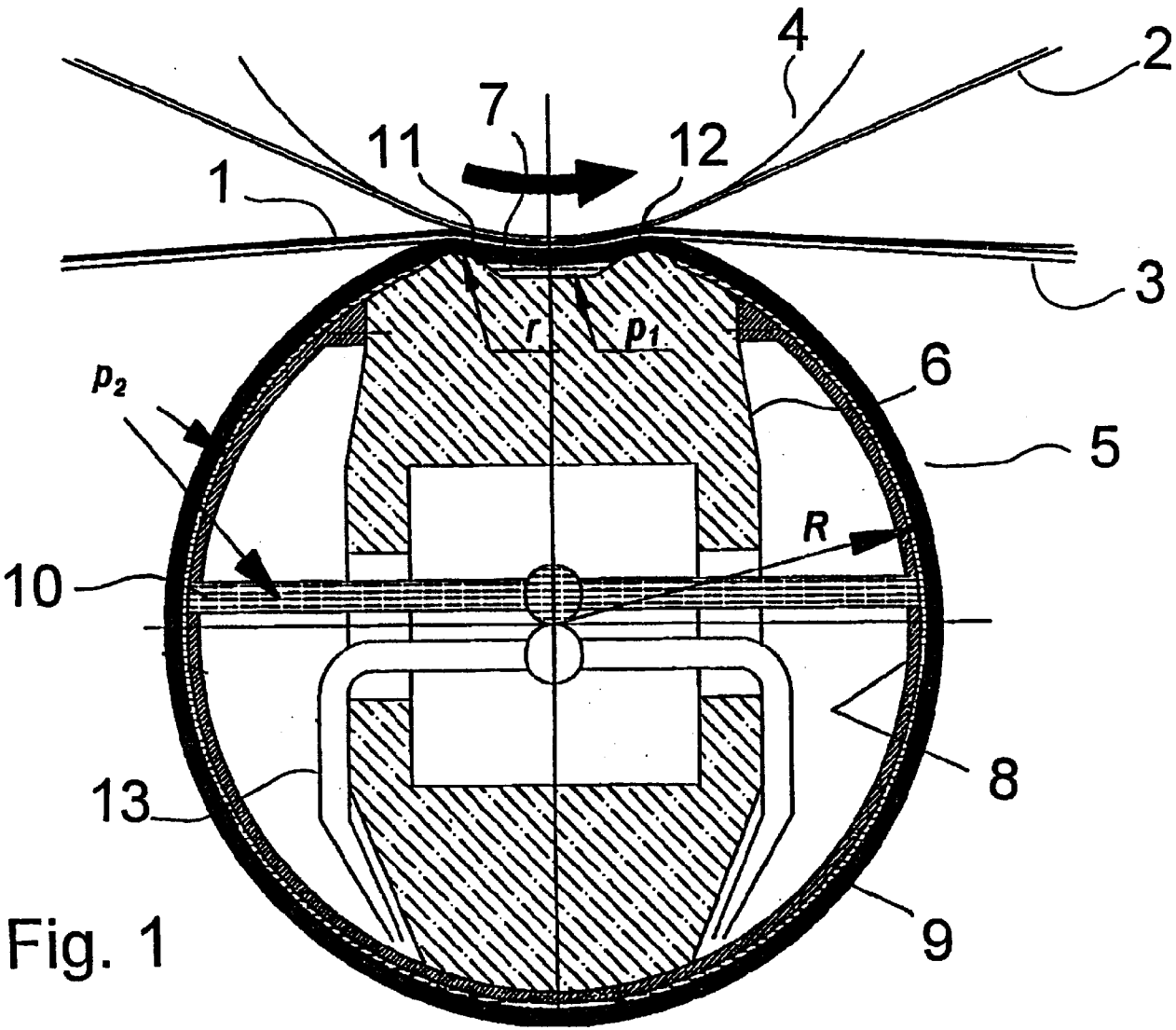

The invention relates to the field of fibre web dewatering. In particular, the invention relates to a long pressing zone press for the treatment of a fibre web.

The dewatering of a fibre web is usually carried out by means of roller presses, by leading the web via a press zone formed by two rolls, i.e. through a press nip. The web runs through the nip between press felts and the felts carry away the water squeezed out of the web.

In a nip formed by two rolls, the greatest pressing force is reached as a narrow peak in the middle of the nip. This is disadvantageous both to the dewatering process and to the service life of the felts, because at high velocities, the pressing is of a very short duration and great stress is put on the felts. Therefore, different kinds of so-called long nip presses have been constructed wherein one roll can be substituted by a concave counterpart, by a press shoe. On the shoe side, the rotary motion of the roll is usually matched by a watertight, endless loop of fabric, a press belt that glides on the surface of the lubricated counterpart following its shape. The press belt is supported by separate rolls, or alternatively, the shoe support is given a shape that enables a short belt to glide around it, lubrication being provided on the inside of the endless loop formed by the belt. By the use of shoe presses, press nips whose effective length can be approximately 250–310 mm, depending on the size of the roll, are achieved. In addition to roll/shoe combinations, the patent documents mentioned later disclose presses composed of two opposite shoes.

Patent application CH5152/86 discloses a press shoe. On its surface, under the press belt, cavities are provided that serve as hydrostatic pressure chambers when hydraulic fluid is led into them through channels in the shoe. In addition to pressure, a stepped heat treatment for the web is achieved by individually regulating the temperature of the hydraulic fluid in the separate chambers. Patent application FI 896163 also discloses a press shoe having a plurality of pockets on its sliding surface for feeding an individually pressurised lubricant, the pressure profile being adjustable in the nip zone for desired pressing and web speed conditions. Swedish patent application SE 9103823-2 discloses a press shoe provided with a pressure pocket, wherein the depth profile of the pressure pocket results in a combination of hydrostatic and hydrodynamic effects for obtaining a desired pressing force profile.

An object of the present invention is to provide a straight forward long nip press structure useable for the dewatering of a fiber web. The shoeless nip press of the present invention includes a roll and a concave counterpart. A hydraulic pressure chamber is provided on the surface of the counterpart, under a gliding press belt. No press shoe in the usual sense of the word is employed, as a result of which no hydraulic cylinder control systems, which are typical of she presses, for adjusting the tilt and the radial position of a shoe are needed.

Because of the simple structure, the sealing of the edges of the hydraulic pressure chamber of the counterpart remains a problem. According to the present invention, the press belt is tightened by pressurising the space on the inside of the press belt in the counterpart. This pressure will hereinafter be referred to as belt pressure. The belt pressure, which is applied to the inner surface of the belt from the direction of the counterpart, is proportional to the pressure of the pressure chamber. When the ratio of the radius of curvature of the pressure chamber edge to the radius of the general path of the belt corresponds to the ratio of the belt pressure to the pressure of the pressure chamber, no oil leakage occurs from the pressure chamber. When the ratio of said pressures is maintained at at a value appropriately lower than that of the ratio of said radii to each other, a sufficient amount of oil escapes from the pressure chamber to lubricate the sliding surfaces between the belt and the counterpart.

The structure of the press is thus considerably simple but provides sufficient means to regulate the compression pressure in the nip zone and, consequently, to influence the properties of the pulp web leaving the press. The edges of the pressure chamber are located outside the nip zone. As the pressure of the chamber forces the belt to follow the surface of the roll, the nip length can be adjusted by adjusting the distance between the roll and the counterpart.

The belt pressure can be generated by means of a fluid, preferably oil; or gas, preferably air. Preferably, the belt is made from fiber reinforced rubber.

The invention will now be described in closer detail with reference to the accompanying drawings wherein.

Figure 2:
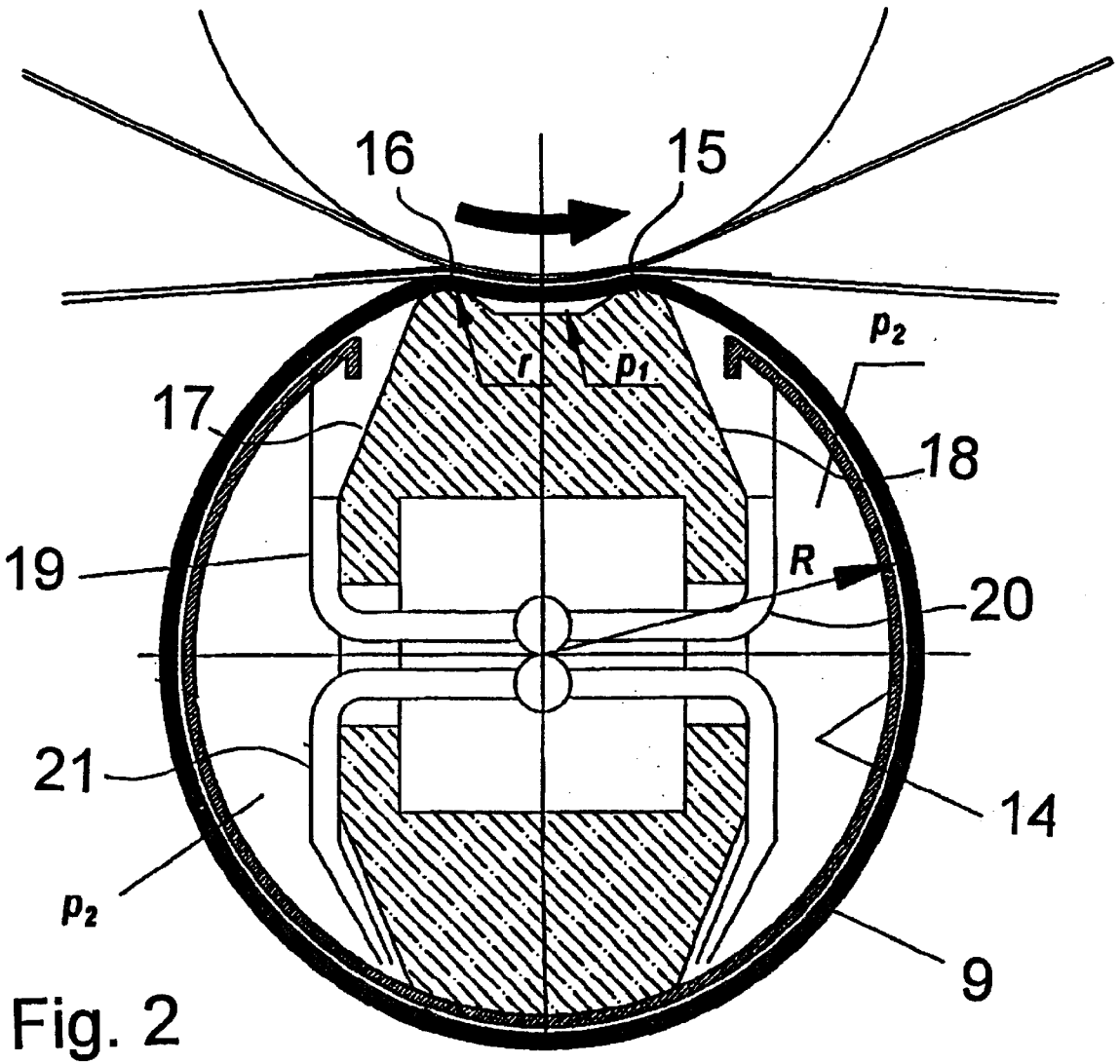

FIG. 1 is a sectional view of a press according to the invention, taken in the direction of web motion, and FIG. 2 is a corresponding sectional view of an another embodiment of a press according to the invention.

Referring to FIG. 1, a fiber web 1 enters the press from the left, supported by felts or wires 2 and 3. A press nip is formed between a roll 4 and a counterpart 5. The counterpart comprises a beam body 6, on which a cavity 7 has been formed, and a cylindrical shell 8. When the press is in use, an endless press belt 9 glides on shell 8. The cavity 7 forms a pressure chamber together with the press belt 9. The force exerted on the web in the nip can be regulated by regulating the pressure of the oil fed to the pressure chamber.

A belt pressure $p_2$ generated by oil fed by means of a pipeline 10 prevails between the press belt 9 and the shell 8. The friction between the press belt and the counterpart is eliminated by allowing oil to leak in a controlled manner over the thresholds 11, 12, the oil carried on the press belt lubricating the sliding surfaces between the belt and the counterpart. A certain oil level can be maintained in the lower section of the counterpart, and the lower part of the shell 8 can be provided with openings below the oil level, if this is necessary for the lubrication of the press belt. The oil in the lower section of the counterpart can be returned to the circulatory system by means of collecting pipes 13.

The force influencing the press belt outside the thresholds 11, 12 is determined by the relation between the counterpart radius R and the edge radius r. When the pressure in the pressure chamber is denoted by $p_1$ and the belt pressure is denoted by $p_2$, the pressures acting on different sides of the edges are in balance when $$\frac{r}{R} = \frac{p_2}{p_1}.$$

In this situation there is no oil leakage, and, consequently, an efficient lubrication requires that $$\frac{r}{R} > \frac{p_2}{p_1}.$$

FIG. 2 shows an alternative structure for the counterpart, wherein the belt pressure is generated by means of compressed air. The shell of the counterpart is constituted by a perforated cylinder 14, and the belt pressure $p_2$ prevails in all parts of the counterpart outside the pressure chamber. The cylinder 14 does not extend to the upper edges of the beam body, but the oil leaking out of the pressure chamber, and further across the edges 15, 16, flows along surfaces 17, 18 into oil collecting chutes 19, 20 from which the oil can be returned to the circulatory system. The counterpart comprises oil-collecting pipes 21 in its lower part as well.

In order to close the ends of the pressure chamber, the chamber can be shaped to taper toward its ends, so that the edges of the chamber eventually join together. The roll is made to taper toward its ends, so that the conical shape thereof corresponds to the tapering pressure chamber.

What is claimed is:

1. A method for dewatering a fiber web in a shoeless nip press, the method comprising:

providing a rotatable cylindrical roll;

providing a counterpart having a recess along a portion of a surface of the counterpart, the recess being defined by edges extending axially along the surface of the counterpart, the edges having a radius r and the counterpart having a radius R;

providing an endless press belt arranged around the counterpart, the recess in the counterpart, and a shell of the counterpart so as to form a shoeless nip between the endless press belt and the rotatable cylindrical roll; and supplying pressurized fluid to the counterpart so that a first pressure $p_1$ is exerted on a portion of the endless press belt that is adjacent to the recess and a second pressure $p_2$ acts between a portion of the endless press belt outside the recess and the counterpart;

wherein r/R is greater than $p_2/p_1$.

2. A method as defined in claim 1, wherein an amount of the pressurized fluid used for lubrication between the endless press belt and the counterpart is controlled by adjusting the second pressure $p_2$.

3. A method as defined in claim 1, wherein pressure under the endless press belt outside the recess along the portion of the surface of the counterpart is generated by pressurized oil.

4. A method as defined in claim 1, wherein pressure under the press belt outside the recess along the portion of the surface of the counterpart is generated by pressurized gas.

5. A method as defined in claim 1, wherein a length of the nip is adjusted by adjusting a distance between the rotatable cylindrical roll and the counterpart.

6. A shoeless nip press comprising:

a rotatable cylindrical roll;

a counterpart having a recess along a portion of a surface of the counterpart, the recess being defined by edges extending axially along the surface of the counterpart, the edges having a radius r and the counterpart having a radius R;

an endless press belt arranged around the counterpart, the recess in the counterpart, and a shell of the counterpart so as to form a shoeless nip between the endless press belt and the rotatable cylindrical roll; and a supply of pressurized fluid to the counterpart so that a first pressure $p_1$ is exerted on a portion of the endless press belt that is adjacent the recess forming the shoeless press nip and a second pressure $p_2$ acts between a portion of the endless press belt outside the recess and the counterpart;

wherein r/R is greater than $p_2/p_1$.

7. A press as defined in claim 6, wherein the fluid is a gas.

8. A press as defined in claim 6, wherein the fluid is a liquid.

9. A method for dewatering a fiber web in a shoeless nip press, the method comprising:

providing a rotatable cylindrical roll;

providing a counterpart having a recess along a portion of a surface of the counterpart;

providing an endless press belt arranged around the counterpart, the recess in the counterpart, and a shell of the counterpart so as to form a shoeless nip between the endless press belt and the rotatable cylindrical roll; and supplying pressurized fluid to the recess in the counterpart so that a first pressure is exerted on a portion of the endless press belt that is adjacent to the recess and a second pressure acts between a portion of the endless press belt outside the recess and the counterpart.

10. A method as defined in claim 9, wherein an amount of the pressurized fluid used for lubrication between the endless press belt and the counterpart is controlled by adjusting the second pressure.

11. A method as defined in claim 9, wherein pressure under the endless press belt outside the recess along the portion of the surface of the counterpart is generated by pressurized oil.

12. A method as defined in claim 9, wherein pressure under the press belt outside the recess along the portion of the surface of the counterpart is generated by pressurized gas.

13. A method as defined in claim 9, wherein a length of the nip is adjusted by adjusting a distance between the rotatable cylindrical roll and the counterpart.

14. A shoeless nip press comprising:

a rotatable cylindrical roll;

a counterpart having a recess along a portion of a surface of the counterpart;

an endless press belt arranged around the counterpart, the recess in the counterpart, and a shell of the counterpart so as to form a shoeless nip between the endless press belt and the rotatable cylindrical roll; and a supply of pressurized fluid to the counterpart so that a first pressure is exerted on a portion of the endless press belt that is adjacent to the recess and a second pressure acts between a portion of the endless press belt outside the recess and the counterpart.

15. A press as defined in claim 14, wherein the fluid is a gas.

16. A press as defined in claim 14, wherein the fluid is a liquid.

17. A press as defined in claim 14, wherein the first pressure is created by a pressurized liquid and the second pressure is created by a pressurized gas.

* * * * *